US008807700B2

(12) United States Patent
Katsuki

(10) Patent No.: US 8,807,700 B2
(45) Date of Patent: Aug. 19, 2014

(54) FLUID EJECTION DEVICE AND MOISTURIZING FLUID SUPPLY CONTROL METHOD

(75) Inventor: Kiyoteru Katsuki, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 197 days.

(21) Appl. No.: 13/425,500

(22) Filed: Mar. 21, 2012

(65) Prior Publication Data

US 2012/0249628 A1 Oct. 4, 2012

(30) Foreign Application Priority Data

Mar. 29, 2011 (JP) ..... 2011-073541

(51) Int. Cl.
*B41J 2/165* (2006.01)

(52) U.S. Cl.
CPC ..... *B41J 2/165* (2013.01)
USPC ..... 347/29

(58) Field of Classification Search
CPC ..... B41J 2/165
See application file for complete search history.

(56) References Cited

U.S. PATENT DOCUMENTS 7,255,420 B2 * 8/2007 Usuda ..... 347/29
2008/0030540 A1 * 2/2008 Suzuki ..... 347/29

FOREIGN PATENT DOCUMENTS

JP 2001018408 A 1/2001
JP 2001253081 A 9/2001
JP 2008105262 A 5/2008

* cited by examiner

*Primary Examiner* — Matthew Luu
*Assistant Examiner* — Tracey McMillion
(74) *Attorney, Agent, or Firm* — Lowe Hauptman & Ham, LLP

(57) ABSTRACT

A fluid ejection device including: a fluid ejection head having a nozzle surface in which fluid ejection nozzles are arrayed; a head cap that covers the nozzle surface; a fluid storage unit in which an ejection fluid that is ejected from the nozzles of the fluid ejection head is stored; a moisturizing fluid supply unit that supplies to the head cap a moisturizing fluid that keeps the head cap moist; a moisturizing fluid storage unit that stores the moisturizing fluid supplied to the head cap from the moisturizing fluid supply unit; and a moisturizing fluid supply control unit that controls the amount of moisturizing fluid supplied to the head cap after the ejection fluid stored in the fluid storage unit reaches a predetermined level.

15 Claims, 6 Drawing Sheets

FLUID EJECTION DEVICE AND MOISTURIZING FLUID SUPPLY CONTROL METHOD

BACKGROUND

1. Technical Field

The present invention relates to a fluid ejection device with a head cap that covers the nozzle surface of the fluid ejection head when the fluid ejection head is not operating, and relates more particularly to a moisturizing fluid supply control method that supplies water or other moisturizing liquid into the head cap to maintain a desirably wet state inside the head cap.

2. Related Art

Devices that use an inkjet head or other type of fluid ejection head that ejects fluid droplets from nozzles commonly cover and seal the nozzle surface of the head with a head cap when not printing to prevent ink left in the nozzles from drying and clogging the nozzles, and to prevent particulate from sticking to or getting in the nozzle surface or nozzles. Flushing, an operation that ejects ink droplets into the head cap from the nozzles of the inkjet head, is also regularly performed to prevent nozzle clogging. The ink droplets ejected in the flushing operation are collected in an ink absorbing member (sponge) inside the head cap, and the ink absorbed by the ink sponge is recovered by an ink recovery unit.

Waste ink absorbed by the ink sponge in the head cap gradually dries, ink viscosity increases, and dried ink accumulates. When the fluid ejection head is then capped, the high concentration of glycerine, diethylene glycol, or other humectant contained in the accumulated waste ink draws water from the ink in the nozzles of the inkjet head, thereby promoting increased viscosity in the ink inside the nozzles and inviting nozzle clogging and ink ejection problems. Water or other moisturizing fluid (referred to as simply water below) is therefore regularly supplied into the head cap to maintain a desirable level of wetness inside the head cap. Inkjet printers having this type of wetting function are described in Japanese Unexamined Patent Appl. Pubs. JP-A-2001-18408, JP-A-2001-253081, and JP-A-2008-105262.

Inkjet printers according to the related art with a function for keeping the inside of the head cap desirably wet have a dedicated water tank or water cartridge. In addition to replacing the ink cartridge that uses ink, this requires replacing the water (moisturizing fluid) as another consumable. The number of consumables that the user must therefore keep on hand increases, consumables must be replaced more frequently, and ease of use is decreased.

For example, the water supply timing varies according to how the user uses the inkjet printer (including printing time and interval between print jobs). As a result, during repeated high duty printing, ink consumption is high and water consumption is low, the ink cartridges must be replaced due to ink depletion more quickly than the water cartridge must be replaced, and the water cartridge must then be replaced sometime after the ink cartridge is replaced. Conversely, during repeated low duty printing, water consumption is high, and the water supply may be depleted before the ink cartridge needs replacing. In this case, the water cartridge must be replaced first. In both cases, however, cartridges need replacing more frequently because the ink cartridge and water cartridge are replaced at different times, thus increasing the user's workload. Not replacing the water cartridge when the water supply is depleted is also not desirable because the head cap cannot be kept desirably wet and problems such as clogged nozzles occur.

SUMMARY

A fluid ejection device and a moisturizing fluid supply control method according to the present invention enable reducing the frequency of moisturizing fluid (water) cartridge replacement and avoiding being unable to keep the head cap wet due to depletion of the water or other moisturizing fluid supply.

One aspect of the invention is a fluid ejection device including: a fluid ejection head having a nozzle surface in which fluid ejection nozzles are arrayed; a head cap that covers the nozzle surface; a fluid storage unit in which an ejection fluid that is ejected from the nozzles of the fluid ejection head is stored; a moisturizing fluid supply unit that supplies to the head cap a moisturizing fluid that keeps the head cap moist; a moisturizing fluid storage unit that stores the moisturizing fluid supplied to the head cap from the moisturizing fluid supply unit; and a moisturizing fluid supply control unit that controls the amount of moisturizing fluid supplied to the head cap after the ejection fluid stored in the fluid storage unit reaches a predetermined amount.

Preferably, the moisturizing fluid supply control unit supplies a specific amount of moisturizing fluid at a predetermined time until the ejection fluid stored in the fluid storage unit reaches a predetermined amount.

Further preferably, until the ejection fluid stored in the fluid storage unit reaches the predetermined amount, the moisturizing fluid supply control unit drives the moisturizing fluid supply unit to perform a moisturizing fluid supply operation that supplies the moisturizing fluid to the head cap when the total drive time (Ta) of the fluid ejection head reaches a predetermined set total (Ts).

When the head cap is not capping the fluid ejection head, the head cap is open. Because moisture inside the head cap evaporates when the head cap is open, the head cap does not remain desirably wet. A moisturizing fluid must therefore be supplied to the head cap when the total time that the head cap is not capping the fluid ejection head, that is, the total time that the head cap is open, reaches a specific value. Because the fluid ejection head is normally being driven when it is not capped, the moisturizing operation can be performed when the total drive time of the fluid ejection head reaches a predetermined set total (Ts).

Further preferably, the moisturizing fluid supply control unit supplies a constant quantity (Q1) of moisturizing fluid to the head cap in the moisturizing fluid supply operations until the ejection fluid stored in the fluid storage unit reaches the predetermined amount.

Because fluid consumption varies according to the fluid ejection state (drive history) of the fluid ejection head, controlling adjustment of the moisturizing fluid supply volume so that the moisturizing fluid and the fluid are depleted at the same time from a state in which sufficient fluid and moisturizing fluid remain in the fluid storage unit and moisturizing fluid storage unit is difficult. A predetermined constant amount (Q1) of moisturizing fluid is therefore supplied to the head cap in each moisturizing fluid supply operation until the remaining amount of fluid becomes sufficiently little, that is, until the remaining amount of fluid reaches a predetermined near-end amount, and after the remaining amount of fluid reaches the near-end amount, the amount of moisturizing fluid supplied in each moisturizing fluid supply operation is preferably adjusted so that the moisturizing fluid in the moisturizing fluid storage unit is used up at the same time as the ejection fluid in the fluid storage unit.

Yet further preferably, the moisturizing fluid supply control unit adjusts the amount (Q2) of moisturizing fluid supplied in the moisturizing fluid supply operation after the ejection fluid stored in the fluid storage unit reaches the predetermined amount.

Yet further preferably, the moisturizing fluid supply control unit calculates the estimated total (Tp=Qne/qm) of the fluid ejection head drive time required for the predetermined amount of ejection fluid to be consumed by dividing the predetermined amount (Qne) by the average fluid consumption (qm) per unit drive time of the fluid ejection head from when the ejection fluid fills the fluid storage unit until when the ejection fluid reaches the predetermined amount; calculates the moisturizing fluid supply count (Np=Tp/Ts) until the ejection fluid reaches a predetermined second amount by dividing the calculated estimated total (Tp) by the set total (Ts); calculates an adjusted moisturizing fluid supply amount (Q2=Qa/Np) by dividing the amount of moisturizing fluid (Qa) when the ejection fluid reached the predetermined amount (Qne) by the supply count (Np); and sets the moisturizing fluid supply amount in the moisturizing fluid supply operation after the ejection fluid reaches the predetermined amount to the adjusted moisturizing fluid supply amount (Q2).

By thus adjusting the amount of moisturizing fluid supplied, depletion of the moisturizing fluid in the moisturizing fluid supply operation immediately preceding depletion of the ejection fluid can be controlled with good precision to reflect actual fluid consumption by the fluid ejection head.

Further preferably, the moisturizing fluid supply control unit calculates the estimated total (Tp=Qne/qm) of the fluid ejection head drive time required for the predetermined amount of ejection fluid to be consumed by dividing the predetermined amount (Qne) by the average fluid consumption (qm) per unit drive time of the fluid ejection head from when the ejection fluid fills the fluid storage unit until when the ejection fluid reaches the predetermined amount; calculates the moisturizing fluid supply count (Np=Tp/Ts) until the ejection fluid reaches a predetermined second amount by dividing the calculated estimated total (Tp) by the set total (Ts); and adjusts the amount of moisturizing fluid supplied to the head cap by moisturizing fluid supply operation Np.

This aspect of the invention calculates the number of times the moisturizing fluid is supplied from when the fluid reaches the near-end state until the fluid is completely spent based on the average fluid consumption per unit drive time of the fluid ejection head from when the fluid storage unit is full until the ejection fluid reaches the near-end amount. As a result, the moisturizing fluid supply operation immediately before the fluid is used up can be timed to the last moisturizing fluid supply operation determined by the calculated supply count. The moisturizing fluid can thus be used up just before the fluid supply is depleted by supplying all of the moisturizing fluid left in the moisturizing fluid storage unit to the cap in this last moisturizing fluid supply operation.

A large amount of moisturizing fluid is supplied into the head cap if a large amount of moisturizing fluid remains in the moisturizing fluid storage unit the last time the moisturizing fluid is supplied. If a large amount of moisturizing fluid is supplied, bubbles and particulate inside the moisturizing fluid supply path and particulate in the head cap can be washed out by the large amount of moisturizing fluid supplied, and the moisturizing fluid supply path can therefore be kept in a good condition.

The fluid storage unit is preferably a fluid cartridge that can be removably installed to a cartridge holder, and the moisturizing fluid storage unit is disposed inside the fluid cartridge. As a result, the moisturizing fluid and the ejection fluid can both be replenished by a single operation. Because the invention controls supplying moisturizing fluid so that the moisturizing fluid and the fluid are depleted substantially simultaneously, the moisturizing fluid will also be depleted when the fluid cartridge is replaced. If a large amount of moisturizing fluid is left, the user may mistakenly think that ejection fluid is also left when the fluid cartridge is replaced, but the invention avoids this. In addition, because substantially no fluid remains in the spent fluid cartridge that is removed for disposal or reuse, substantially no fluid is wasted, which is economical and helps reduce the impact on the environment.

The invention can also be used in a color inkjet printer. In this case an inkjet head is used as the fluid ejection head, and ink cartridges storing different colors of ink, generally cyan, magenta, yellow, and black, are used as the fluid cartridges. Of these colors, consumption of black ink is greatest, and the black ink cartridge is commonly a size larger than the ink cartridges for the other colors. As a result, even if the moisturizing fluid storage unit is disposed in the black ink cartridge and the size of the black ink cartridge is increased by the size of the moisturizing fluid storage unit, the user is unlikely to be surprised because the black ink cartridge is already usually larger than the other ink cartridges.

Another aspect of the invention is a moisturizing fluid supply control method for a fluid ejection device, including steps of: ejecting ejection fluid stored in a fluid storage unit from a fluid ejection head, and supplying moisturizing fluid stored in a moisturizing fluid storage unit to a head cap when the ejection fluid is ejected by the fluid ejection head; and controlling the amount of moisturizing fluid supplied to the head cap after the ejection fluid stored in the fluid storage unit reaches a predetermined amount.

Effect of the invention

The invention uses up the moisturizing fluid in the moisturizing fluid storage unit simultaneously to or just before the ejection fluid stored in the fluid storage unit is used up. As a result, the empty moisturizing fluid storage unit can be refilled or replaced at the same time the fluid storage unit is refilled with fluid or the fluid storage unit is replaced with a new fluid storage unit. The head cap can therefore be kept wet without sacrificing ease of use for the user. In addition, because the moisturizing fluid runs out simultaneously to or just before the ejection fluid, problems such as the inside of the head cap drying and nozzles becoming clogged as a result of continuing the fluid ejection operation of the fluid ejection head for an extended time after the moisturizing fluid is spent can be prevented.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of an inkjet printer according to the present invention is described below with reference to the accompanying figures.

Figure 1:
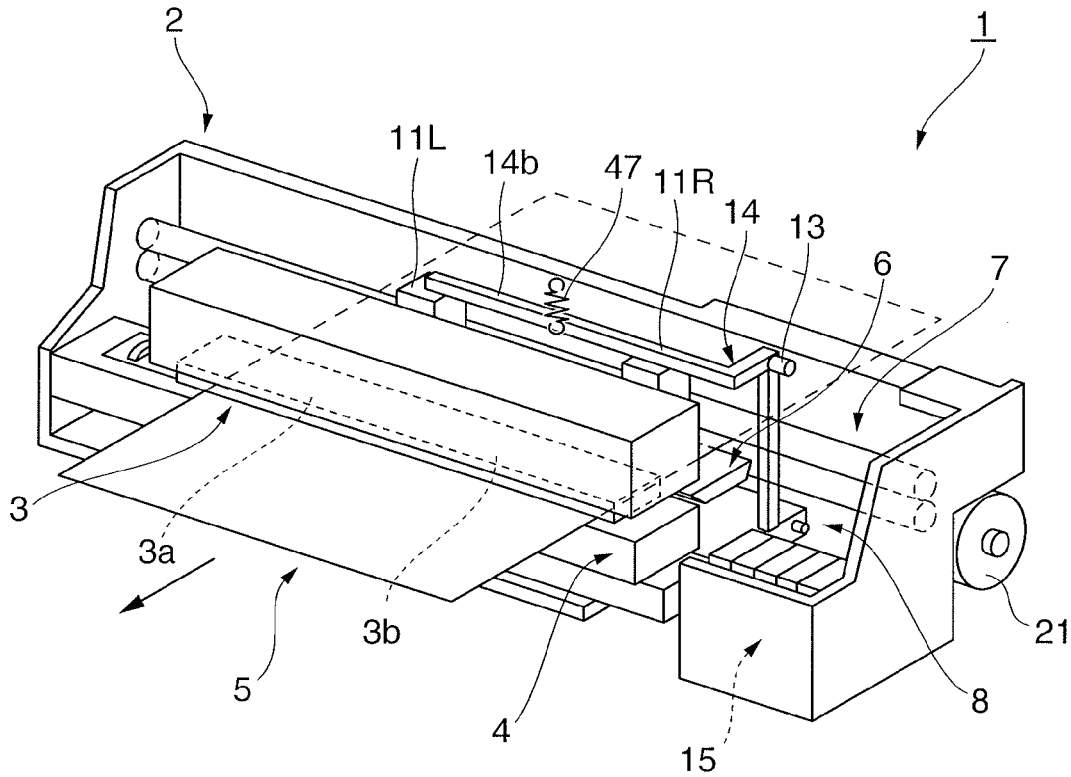
FIG. 1 schematically describes an inkjet printer according to the invention.
Figure 2:
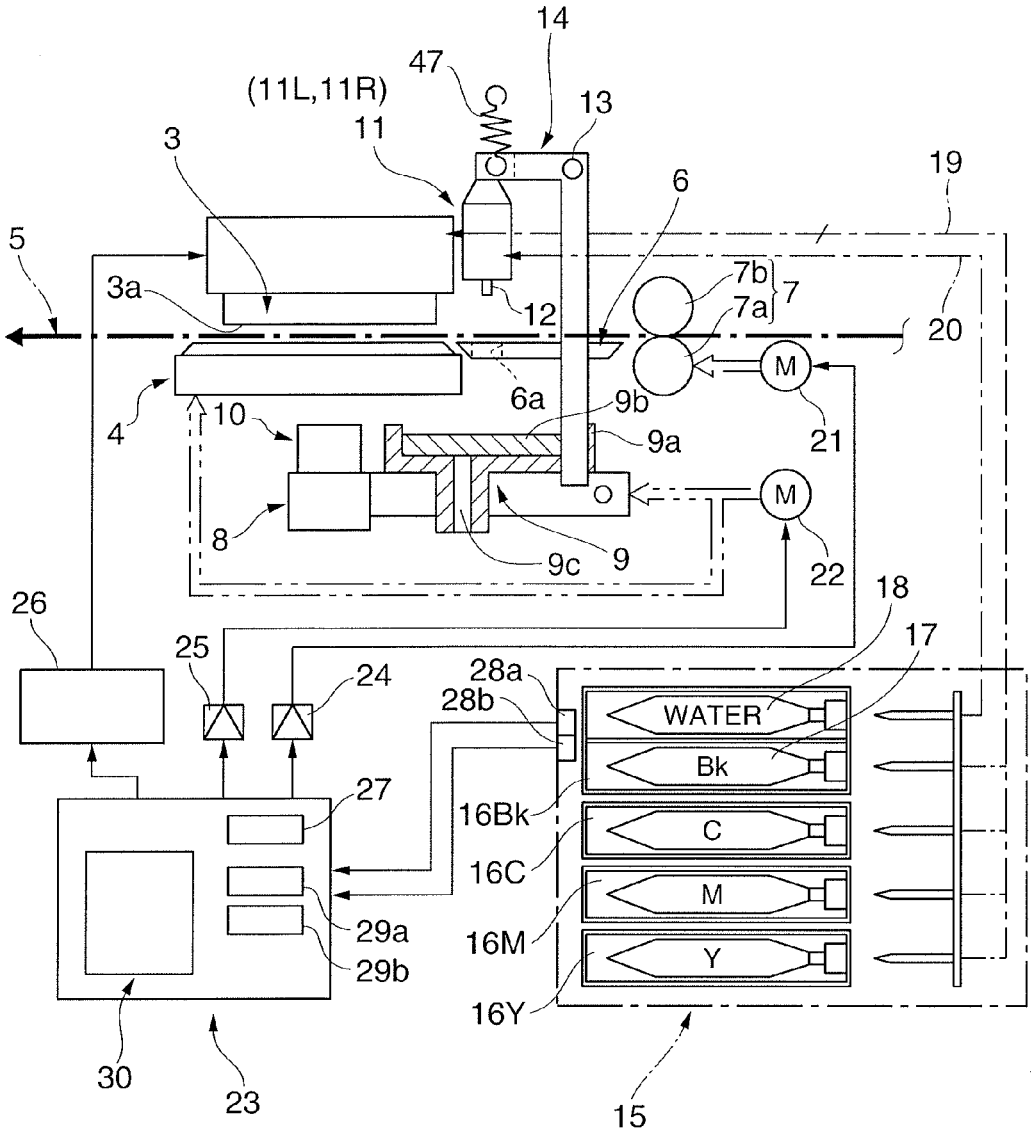
FIG. 2 describes main parts of the inkjet printer together with the control system.

FIG. 1 shows the general configuration of main parts of an inkjet printer, and FIG. 2 shows the main parts in section view together with the control system. As shown in these figures, the inkjet printer 1 has an inkjet line head 3 mounted on a printer frame 2. The inkjet head 3 is disposed horizontally widthwise to the printer with the nozzle surface 3*a* facing down. Plural lines of nozzles 3*b* are formed in the nozzle surface 3*a* across the width of the printer. A movable platen 4 is disposed opposite the bottom of the nozzle surface 3*a* with a specific gap therebetween, and the printing position of the inkjet head 3 is determined by the surface of the movable platen 4. A printing paper 5 conveyance path is formed horizontally from the back to the front of the printer past the printing position. The conveyance path includes a paper feed guide 6 and paper feed roller pair 7.

The paper feed guide 6 is disposed horizontally widthwise to the printer behind the movable platen 4 (on the upstream side in the paper feed direction).

The paper feed roller pair 7 includes a drive roller 7*a* and a follower roller 7*b*, and is disposed horizontally widthwise to the printer at a position behind the paper feed guide 6.

The printing paper 5 is conveyed by the paper feed roller pair 7 from the back to the front through the conveyance path, and is printed on at the printing position by the inkjet head 3.

A movable maintenance unit 8 is disposed horizontally widthwise to the printer below the movable platen 4. The maintenance unit 8 includes a head cap 9 of a size that enables capping the nozzle surface 3*a* of the inkjet line head 3, and a wiper 10 for wiping the nozzle surface 3*a*.

As shown in FIG. 2, the head cap 9 includes a cap body 9*a* that is open at the top, and a flat ink sponge 9*b* of a specific thickness held on the inside bottom of the cap body 9*a*. A waste ink suction port 9*c* is formed in the bottom of the cap body 9*a*, and waste ink absorbed by the ink sponge 9*b* can be recovered through the waste ink suction port 9*c* into a waste ink recovery unit not shown.

Two water supply units 11L, 11R are disposed behind the inkjet head 3. The water supply units 11L, 11R are disposed at the same height with a specific gap therebetween widthwise to the printer. The water supply units 11L, 11R are identically constructed, and therefore collectively referred to as simply water supply unit 11 below. As shown in FIG. 2, a water nozzle 12 is attached pointing down from the bottom of the water supply unit 11, and water ejected down therefrom can be supplied through a through-hole 6*a* formed in the paper feed guide 6 to the ink sponge 9*b* in the head cap 9 therebelow.

As described below, the water supply operation of the water supply unit 11 is driven by a rocker link 14 that can rock vertically on a horizontal rocker shaft 13 extending widthwise to the printer. The rocker link 14 rocks in conjunction with movement of the movable maintenance unit 8 as described below (see FIG. 3).

An ink cartridge holder 15 is also disposed to the printer frame 2, and ink cartridges can be removably installed to the ink cartridge holder 15. As shown in FIG. 2, this embodiment uses four ink cartridges 16C, 16M, 16Y, 16Bk respectively storing cyan, magenta, yellow, and black ink. A black ink tank 17 and a water tank 18 are included in the black ink cartridge 16Bk. Water is stored as a moisturizing fluid in the water tank 18. A moisturizing fluid other than water can obviously also be used. Ink from the ink cartridges is supplied through an ink path 19 to the nozzle lines that eject each color of ink from the inkjet head 3. Water from the water tank 18 inside the black ink cartridge 16Bk is supplied through a water supply path 20 to the water supply unit 11.

The paper feed roller pair 7 is rotationally driven by a paper feed motor 21. Moving the maintenance unit 8 and moving the movable platen 4 are done by another drive motor 22. A printer control circuit 23 consisting primarily of a computer controls driving the motors 21, 22 through motor drivers 24, 25. The printer control circuit 23 also controls driving the inkjet head 3 through a head driver 26. The printer control circuit 23 also functions as a water supply control unit 30 that keeps the inside of the head cap 9 desirably wet.

The water supply control unit 30 includes a total calculator 27 that counts the total print time of the inkjet head 3; a remaining water monitor 29*a* that detects depletion of the water supply based on a detection signal from a detector 28*a* disposed to the ink cartridge holder 15; and a remaining ink monitor 29*b* that detects a near-end state in which there is little remaining black ink Bk based on the detection signal from a detector 28*b* disposed to the ink cartridge holder 15. The water supply control unit 30 applies moisture control to keep the inside of the head cap 9 desirably wet based on the total print time and the remaining amounts of water and black ink.

The water supply control unit 30 controls the amount of water supplied from the water supply unit 11 into the head cap 9 so that the water supply in the water tank 18 is depleted by the water supply operation performed immediately before the black ink Bk supply in the black ink cartridge 16Bk is depleted.

Operation of the Water Supply Unit

Figure 3A:
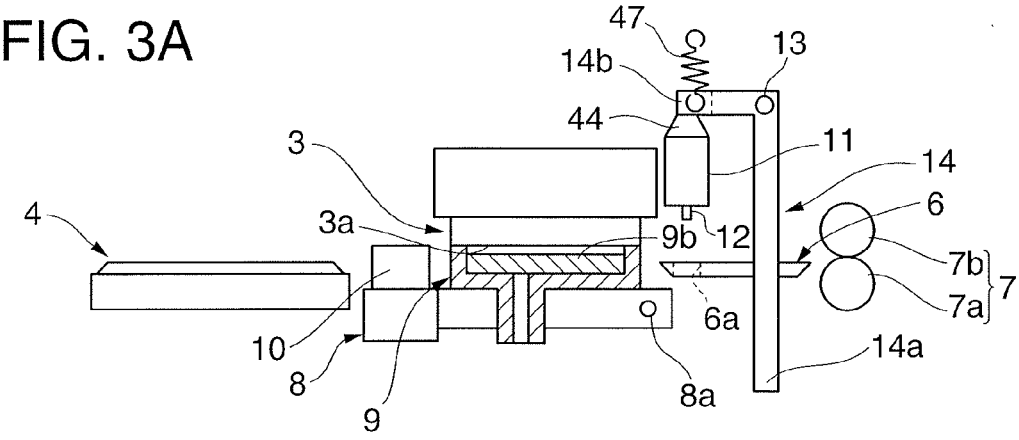
FIG. 3 describes the water supply operation.
Figure 3B:
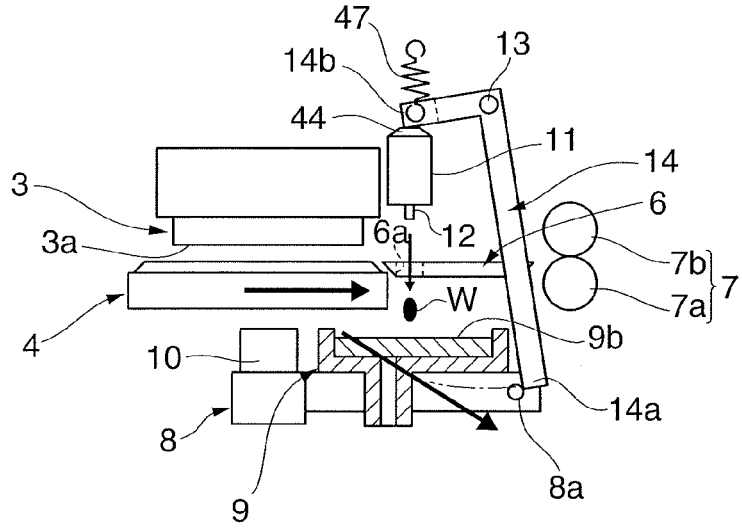
Figure 3C:
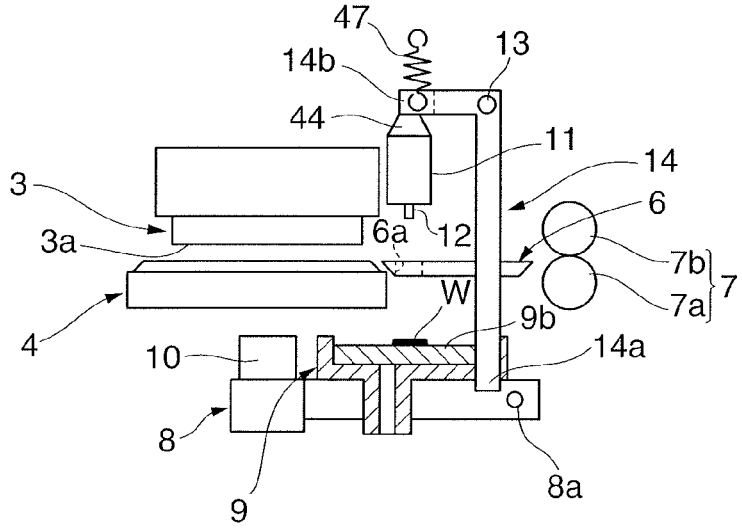
Figure 4:
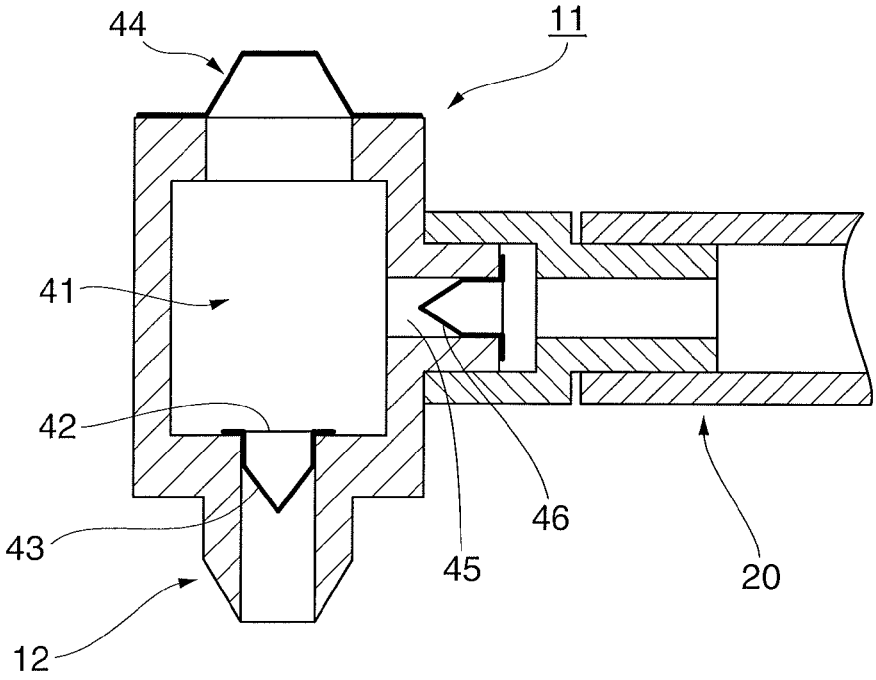
FIG. 4 is a section view of the water supply unit.

FIG. 3 describes the water supply operation of the water supply unit 11, and FIG. 4 is a section view of the water supply unit 11.

Movement of the movable platen 4 and the maintenance unit 8 is described next with reference to these figures. When printing, the movable platen 4 is located directly below the inkjet head 3, and the maintenance unit 8 is set to a standby position below and slightly behind the movable platen 4, as shown in FIG. 3C.

When not printing, the nozzle surface 3*a* of the inkjet head 3 is capped by the head cap 9. As a result, after the printing operation ends, the movable platen 4 is driven horizontally forward and moves to the retracted position shown in FIG. 3A. At the same time, the maintenance unit 8 moves forward and diagonally up to the capping position where the head cap 9 caps the nozzle surface 3*a* of the inkjet head 3 from below as shown in FIG. 3A.

The maintenance unit 8 has an engagement pin 8*a*, and the path of engagement pin 8*a* movement is set to overlap the rocking path of the bottom end 14*a* of the rocker link 14 pivoting on the rocker shaft 13. Therefore, when the maintenance unit 8 moves forward and diagonally up, the engagement pin 8*a* pushes the bottom end 14*a* of the rocker link 14 forward from behind. As a result, the top end 14*b* of the rocker link 14 swings up pivoting on the rocker shaft 13. This top end 14*b* is connected to the water supply unit 11.

As shown in FIG. 4, the water supply unit 11 has a tubular water tank 41. This water tank 41 communicates with the nozzle 12 through a backflow preventer 43 disposed to the supply port 42 formed in the bottom of the water tank 41. The top of the water tank 41 is open, and a diaphragm 44 that can flex vertically closes the top of this opening. A suction port 45 formed in the side of the water tank 41 communicates through a backflow preventer 46 with the water supply path 20.

The diaphragm. 44 of the water supply unit 11 is connected to the top end 14*b* of the rocker link 14. When the rocker link 14 pivots up due to the engagement pin 8*a* of the maintenance unit 8 moving forward and diagonally up from the position shown in FIG. 3C, the diaphragm 44 is lifted up and the internal capacity of the water tank 41 increases. As a result, water is suctioned (supplied) from the water supply path 20 through the backflow preventer 46 into the water tank 41. As the maintenance unit 8 moves forward, the engagement pin 8*a* separates from the bottom end 14*a* of the rocker link 14 to the front. The rocker link 14 then returns to the rocking position where the force of a tension spring 47 from which the rocker link 14 is suspended, and the elastic restoring force of the diaphragm 44, are balanced. Water is thus supplied to the water supply unit 11 during the transition from the printing state shown in FIG. 3C to the non-printing state shown in FIG. 3A.

When transitioning from the capping position shown in FIG. 3A to the printing position, the maintenance unit 8 first starts moving to the back and diagonally down. As the maintenance unit 8 moves down, the wiper 10 disposed thereto moves to the back while pressed against the nozzle surface 3*a* and thus wipes the nozzle surface 3*a*.

The water supply unit 11 is also driven by movement of the maintenance unit 8 to supply water into the head cap 9. More specifically, as shown in FIG. 3B, the engagement pin 8*a* of the maintenance unit 8 contacts the bottom end 14*a* of the rocker link 14 while moving, and causes the rocker link 14 to pivot up on the rocker shaft 13. As a result, the top end 14*b* of the rocker link 14 swings down, the diaphragm 44 of the water supply unit 11 connected thereto is pushed down, and the internal capacity of the water tank 41 decreases.

As a result, water in the water tank 41 is pushed through the backflow preventer 43 to the nozzle 12 side, and is ejected down from the nozzle 12. At this point the head cap 9 of the maintenance unit 8 is directly below the nozzle 12. The water W ejected from the nozzle 12 is therefore supplied through the through-hole 6*a* in the paper feed guide 6 to the ink sponge 9*b* in the head cap 9, and is absorbed and retained thereby. By thus supplying water W, the inside of the head cap 9 is kept in desirably wet. When a greater amount of water W is needed, water W can be repeatedly supplied from the water supply unit 11 to the head cap 9 by moving the maintenance unit 8 repeatedly.

Note that the movable platen 4 moves horizontally toward the back synchronized to movement of the maintenance unit 8, and is positioned directly below the nozzle surface 3*a* of the inkjet head 3 as shown in FIG. 3C. Printing is thus enabled again.

Water Supply Control

Figure 5A:
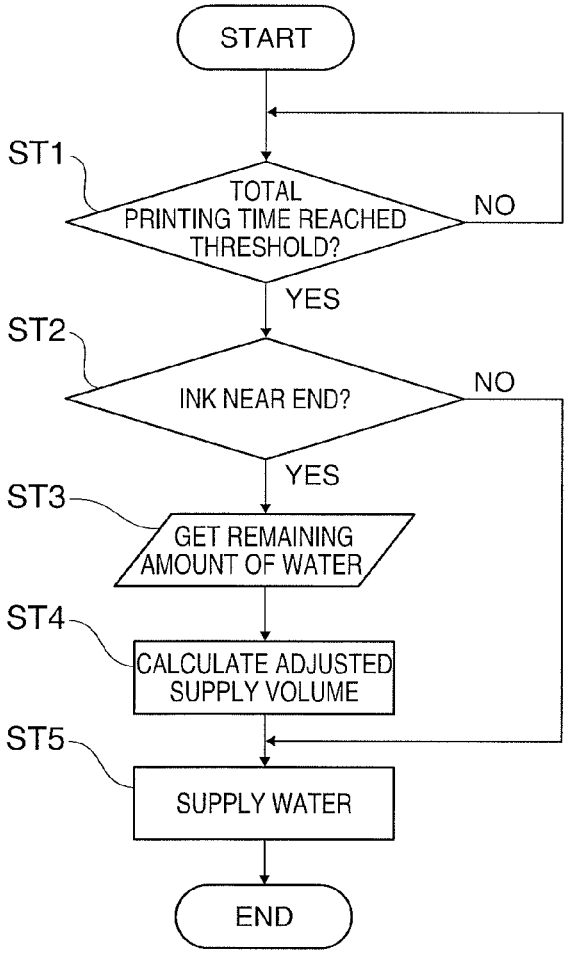
FIG. 5 is a flow chart and graph of the water supply operation.
Figure 5B:
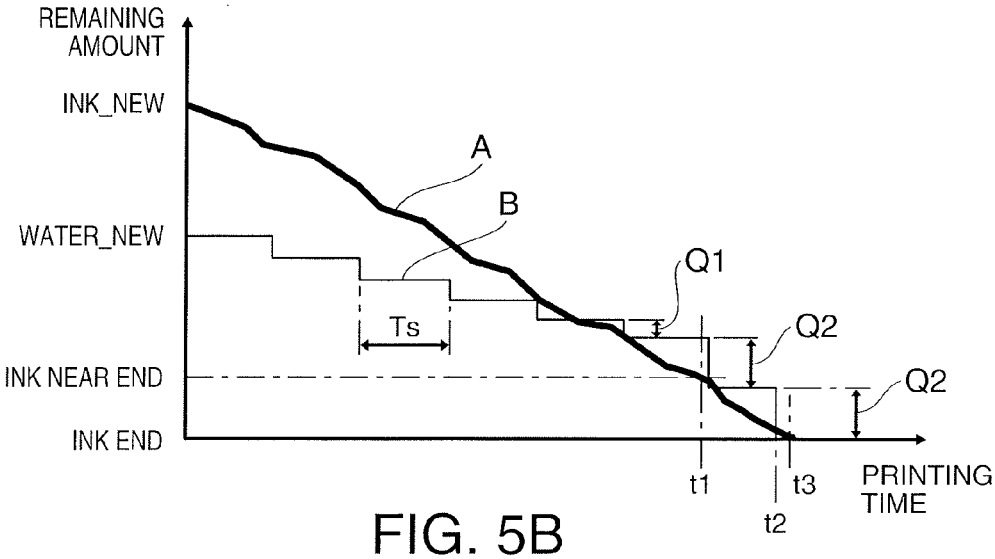

FIG. 5A is a flow chart of the operation whereby the printer control circuit 23 of the inkjet printer 1 controls supplying water to the head cap 9, and FIG. 5B is a graph showing change in the remaining amount of black ink and water.

Referring to these figures, the total calculator 27 of the printer control circuit 23 monitors if the total printing time of the inkjet head 3 has reached a previously set total printing time Ts as shown in step ST1 (total printing time reached threshold?) in FIG. 5A. If the preset total printing time Ts is reached, the water supply control unit 30 drives the water supply unit 11 to perform the water supply operation that supplies water to the head cap 9.

In this embodiment, a constant quantity Q1 of water W is supplied in each water supply operation to the head cap 9 to keep the inside of the head cap 9 desirably wet until the remaining amount of black ink Bk drops to a predetermined near-end volume Qne. More specifically, the remaining ink monitor 29*b* monitors the amount of black ink Bk remaining in the black ink tank 17 as shown in step ST2 (ink near end?) In FIG. 5A. If the total printing time reaches the preset total printing time Ts before the remaining amount of black ink Bk drops to the near-end volume Qne, control goes from step ST1 through step ST2 to step ST5 in FIG. 5A, and a water supply operation that supplies the preset quantity Q1 of water W to the head cap 9 is performed.

As shown by curve A in FIG. 5B, the remaining amount of black ink Bk in the black ink tank 17 is gradually consumed by printing and decreases from the full level (at time t0). As shown by curve B, the remaining amount of water W in the water tank 18 is consumed in units of constant quantity Q1 by the water supply operation performed every total printing time Ts and gradually decreases in steps from the full level (at time t0).

After the remaining ink monitor 29*b* detects that the remaining amount of black ink Bk reached the near-end volume Qne (time t1 in FIG. 5B), the amount of water supplied in each water supply operation is adjusted so that the water W in the water tank 18 is depleted just before (at time t2) the black ink Bk in the black ink tank 17 is completely depleted (at the ink end at time t3).

More specifically, after the near end is detected (step ST2 returns Yes), control goes from step ST2 in FIG. 5A to step ST3 (get remaining water volume), and the remaining water monitor 29*a* detects the remaining amount of water Qa in the water tank 18. Control then goes to step ST4 (calculate next supply volume) in FIG. 5A, and the adjusted water supply volume Q2 is calculated. Step ST4 first calculates the average black ink consumption qm per unit drive time of the inkjet head 3 from when the black ink tank 17 was full at time t0 until the near end was detected at time t1. Next, near-end volume Qne is divided by this average black ink consumption qm to calculate the estimated total Tp (=Qne/qm) of the inkjet head 3 printing time required to use up the near-end volume Qne of black ink Bk.

The number of water supply operations Np (=Tp/Ts) until the black ink Bk is depleted is then calculated by dividing the calculated estimated total Tp by the total printing time Ts. The calculated result in this example is Np=2. The remaining amount of water Qa at time t1 when the black ink Bk went to the near-end volume Qne is then divided by the number of water supply operations Np (=2) to get adjusted water supply volume Q2 (=Qa/Np).

Control then goes to step ST5 (supply water) in FIG. 5A, and a water supply operation that supplies the calculated adjusted water supply volume Q2 to the head cap 9 is performed. As shown in FIG. 5B, the remaining amount of water is supplied and depleted in two operations in this example, and adjusted water supply volume Q2 is several times the normal quantity Q1 supplied. As described above with reference to FIG. 3 and FIG. 4, because the water supply unit 11 is driven and water supplied by moving the maintenance unit 8 reciprocally, the water supply unit 11 is driven repeatedly by reciprocally moving the maintenance unit 8 repeatedly to supply water W of adjusted water supply volume Q2 to the head cap 9.

The water W in the water tank 18 can thus be completely spent by the last water supply operation that is performed at time t2 just before the time when the black ink Bk in the black ink tank 17 is completely consumed (ink end time t3). When the black ink cartridge 16Bk is then replaced after the ink end, both the black ink Bk and the water W will be completely spent.

Other Embodiments

The embodiment described above supplies the remaining water in equal portions after the black ink Bk drops to the near end level. Alternatively, all of the remaining water could be supplied to the head cap 9 and spent in the last water supply operation performed just before the black ink Bk ends.

In this case the remaining water monitor 29*a* first detects the remaining amount of water Qa in the water tank 18. Next, the average black ink consumption qm per unit drive time of the inkjet head 3 from when the black ink tank 17 was full at time t0 until the near end was detected at time t1 is calculated; and the estimated total Tp (=Qne/qm) of the inkjet head 3 printing time required to use up the near-end volume Qne of black ink Bk is calculated by dividing near-end volume Qne divided by the average black ink consumption qm.

The number of water W supply operations Np (=Tp/Ts) until the black ink Bk is spent is then calculated by dividing the calculated estimated total Tp by the total printing time Ts. The calculated result in this example is Np=2. As a result, the time of the water supply operation performed just before the black ink Bk supply is depleted can be identified as the time of the water supply operation corresponding to the last water supply operation determined by the calculated count Np, and in this example is the second operation.

Figure 6A:
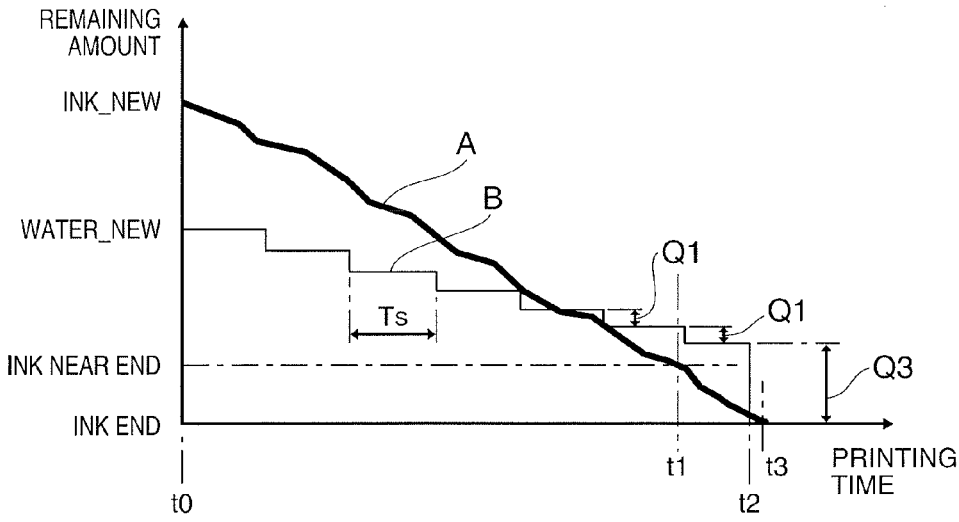
FIG. 6 is a graph of another example of the water supply operation.

As shown in the graph in FIG. 6A, water is supplied in the first water supply operation after the near end is detected at the same constant quantity Q1 that was supplied before the near end was detected. The last water supply operation, that is, the second water supply operation in this example, supplies all of the remaining water (remaining amount Q3). As a result, the water supply can be depleted at time t2 just before the black ink Bk supply is depleted.

When a large amount of water remains in the water tank 18 in the last water supply operation, this control method supplies a large amount of water to the head cap 9. If a large amount of water is supplied, bubbles and particulate inside the water supply path and particulate in the head cap 9 can be washed out by the large amount of water supplied, and the water supply path can therefore be kept in a good condition.

Figure 6B:
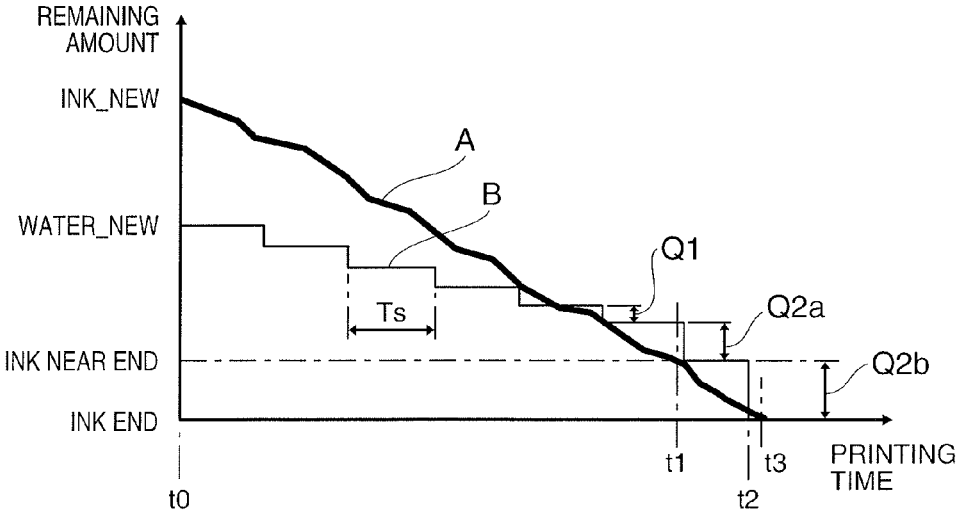

As shown in FIG. 6B, the amount of water W supplied could be kept at quantity Q1 until the black ink Bk reaches the near end level, and after the black ink Bk drops to the near end level, the water supply could be gradually increased as indicated by Q2*a* and Q2*b*.

In addition, detecting depletion of the black ink Bk could trigger a supply operation that reciprocally drives the maintenance unit 8 to supply water from the water supply unit 11 to the head cap 9 until all remaining water W is consumed. As a result, all remaining water W can be consumed when the black ink Bk is spent so that both are used up at the same time.

The water supply unit 11 is driven through the rocker link 14 in conjunction with movement of the maintenance unit 8 in the foregoing embodiment as shown in FIG. 3, but a dedicated drive source for driving the water supply unit 11 could be provided. In addition, supplying the adjusted water supply volume Q2 of water can be controlled with good precision by using a different mechanism than the mechanism of the water supply unit 11 described above to supply water to the head cap, such as a fluid ejection mechanism similar to that of the inkjet head. Further alternatively, water could be supplied to the head cap using the suction operation of a suction pump connected to the head cap, although this complicates controlling the amount of water supplied and results in less precise control of the supply volume.

The embodiment described above applies the invention to an inkjet printer. The invention is not so limited, however, and can be similarly applied to fluid ejection devices other than inkjet printers. For example, the invention can also be used in fluid ejection devices having a fluid ejection head that ejects fluids such as electrode materials and colorants used to form electrodes for LCD panels, OLED displays, surface-emission displays, and other devices. The invention can also be applied to fluid ejection devices having a fluid ejection head that ejects bioorganic compounds used in biochip manufacture, and fluid ejection devices having a fluid ejection head that ejects reagents from a nozzle used as a precision pipette.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No: 2011-73541, filed Mar. 29, 2011 is expressly incorporated by reference herein.

What is claimed is:

1. A fluid ejection device comprising:

a fluid ejection head having a nozzle surface in which fluid ejection nozzles are arrayed;

a head cap that covers the nozzle surface;

a fluid storage unit in which an ejection fluid that is ejected from the nozzles of the fluid ejection head is stored;

a moisturizing fluid supply unit that supplies to the head cap a moisturizing fluid that keeps the head cap moist;

a moisturizing fluid storage unit that stores the moisturizing fluid supplied to the head cap from the moisturizing fluid supply unit; and a moisturizing fluid supply control unit that controls the amount of moisturizing fluid supplied to the head cap after the ejection fluid stored in the fluid storage unit reaches a predetermined amount, wherein:

until the ejection fluid stored in the fluid storage unit reaches the predetermined amount, the moisturizing fluid supply control unit controls a specific amount of moisturizing fluid supplied to the head cap at a predetermined time.

2. The fluid ejection device described in claim 1, wherein:

until the ejection fluid stored in the fluid storage unit reaches the predetermined amount, the moisturizing fluid supply control unit drives the moisturizing fluid supply unit to perform a moisturizing fluid supply operation that supplies the moisturizing fluid to the head cap when the total drive time (Ta) of the fluid ejection head reaches a predetermined set total (Ts).

3. The fluid ejection device described in claim 2, wherein:

the moisturizing fluid supply control unit controls a constant quantity (Q1) of moisturizing fluid is supplied to the head cap in the moisturizing fluid supply operation until the ejection fluid stored in the fluid storage unit reaches the predetermined amount.

4. The fluid ejection device described in claim 3, wherein:

the moisturizing fluid supply control unit adjusts the amount (Q2) of moisturizing fluid supplied in the moisturizing fluid supply operation after the ejection fluid stored in the fluid storage unit reaches the predetermined amount.

5. The fluid ejection device described in claim 4, wherein:

the moisturizing fluid supply control unit calculates the estimated total (Tp=Qne/qm) of the fluid ejection head drive time required for the predetermined amount of ejection fluid to be consumed by dividing the predetermined amount (Qne) by the average fluid consumption (qm) per unit drive time of the fluid ejection head from when the ejection fluid fills the fluid storage unit until when the ejection fluid reaches the predetermined amount, calculates the moisturizing fluid supply count (Np=Tp/Ts) until the ejection fluid reaches a predetermined second amount by dividing the calculated estimated total (Tp) by the set total (Ts), calculates an adjusted moisturizing fluid supply amount (Q2=Qa/Np) by dividing the amount of moisturizing fluid (Qa) when the ejection fluid reached the predetermined amount (Qne) by the supply count (Np), and sets the moisturizing fluid supply amount in the moisturizing fluid supply operation after the ejection fluid reaches the predetermined amount to the adjusted moisturizing fluid supply amount (Q2).

6. The fluid ejection device described in claim 4, wherein:

the moisturizing fluid supply control unit calculates the estimated total (Tp=Qne/qm) of the fluid ejection head drive time required for the predetermined amount of ejection fluid to be consumed by dividing the predetermined amount (Qne) by the average fluid consumption (qm) per unit drive time of the fluid ejection head from when the ejection fluid fills the fluid storage unit until when the ejection fluid reaches the predetermined amount, calculates the moisturizing fluid supply count (NpH=Tp/Ts) until the ejection fluid reaches a predetermined second amount by dividing the calculated estimated total (Tp) by the set total (Ts), and adjusts the amount of moisturizing fluid supplied to the head cap by moisturizing fluid supply operation Np.

7. A fluid ejection device comprising:

a fluid ejection head having a nozzle surface in which fluid ejection nozzles are arrayed;

a head ca. that covers the nozzle surface;

a fluid storage unit in which an ejection fluid that is ejected from the nozzles of the fluid ejection head is stored;

a moisturizing fluid supply unit that supplies to the head cap a moisturizing fluid that keeps the head cap moist:

a moisturizing fluid storage unit that stores the moisturizing fluid supplied to the head cap from the moisturizing fluid supply unit; and a moisturizing fluid supply control unit that controls the amount of moisturizing fluid supplied to the head cap after the ejection fluid stored in the fluid storage unit reaches a predetermined amount., wherein:

the fluid storage unit includes a fluid cartridge in which the ejection fluid is stored, and a cartridge holding unit in which the fluid cartridge can be removably installed; and the moisturizing fluid storage unit is disposed in the fluid cartridge.

8. The fluid ejection device described in claim 7, wherein:

the fluid ejection head is an inkjet head; and the ejection fluid stored in the fluid storage unit is black ink.

9. A moisturizing fluid supply control method for a fluid ejection device, comprising steps of:

ejecting ejection fluid stored in a fluid storage unit from a fluid ejection head, and supplying moisturizing fluid stored in a moisturizing fluid storage unit to a head cap when the ejection fluid is ejected by the fluid ejection head; and controlling the amount of moisturizing fluid supplied to the head cap after the ejection fluid stored in the fluid storage unit reaches a predetermined amount.

10. The moisturizing fluid supply control method for a fluid ejection device described in claim 9, wherein:

until the ejection fluid stored in the fluid storage unit reaches the predetermined amount, a specific amount of moisturizing fluid is supplied at a predetermined time.

11. The moisturizing fluid supply control method for a fluid ejection device described in claim 10, wherein:

until the ejection fluid stored in the fluid storage unit reaches the predetermined amount, moisturizing fluid is supplied to the head cap when the total drive time (Ta) of the fluid ejection head reaches a predetermined set total (Ts).

12. The moisturizing fluid supply control method for a fluid ejection device described in claim 11, wherein:

a constant quantity (Q1) of moisturizing fluid is supplied to the head cap until the ejection fluid stored in the fluid storage unit reaches the predetermined amount.

13. The moisturizing fluid supply control method for a fluid ejection device described in claim 12, further comprising a step of:

adjusting the amount (Q2) of moisturizing fluid supplied after the ejection fluid stored in the fluid storage unit reaches the predetermined amount.

14. The moisturizing fluid supply control method for a fluid ejection device described in claim 13, further comprising steps of:

calculating the estimated total (Tp=Qne/qm) of the fluid ejection head drive time required for the predetermined amount of ejection fluid to be consumed by dividing the predetermined amount (Qne) by the average fluid consumption (qm) per unit drive time of the fluid ejection head from when the ejection fluid fills the fluid storage unit until when the ejection fluid reaches the predetermined amount;

calculating the moisturizing fluid supply count (Np=Tp/Ts) until the ejection fluid reaches a predetermined second amount by dividing the calculated estimated total (Tp) by the set total (Ts);

calculating an adjusted moisturizing fluid supply amount (Q2=Qa/Np) by dividing the amount of moisturizing fluid (Qa) when the ejection fluid reached the predetermined amount (Qne) by the supply count (Np); and supplying the adjusted moisturizing fluid supply amount (Q2) of moisturizing fluid to the head cap.

15. The moisturizing fluid supply control method for a fluid ejection device described in claim 13, further comprising steps of:

calculating the estimated total (Tp=Qne/qm) of the fluid ejection head drive time required for the predetermined amount of ejection fluid to be consumed by dividing the predetermined amount (Qne) by the average fluid consumption (qm) per unit drive time of the fluid ejection head from when the ejection fluid fills the fluid storage unit until when the ejection fluid reaches the predetermined amount;

calculating the moisturizing fluid supply count (Np=Tp/Ts) until the ejection fluid reaches a predetermined second amount by dividing the calculated estimated total (Tp) by the set total (Ts); and adjusting the amount of moisturizing fluid supplied to the head cap when moisturizing fluid is supplied to the head cap the Np-th time.

* * * * *